US008464466B1

(12) United States Patent
Kunz

(10) Patent No.: US 8,464,466 B1
(45) Date of Patent: Jun. 18, 2013

(54) WINDOW HAVING A COUNTERBALANCE SYSTEM THAT MAXIMIZES EGRESS OPENING

(76) Inventor: John R. Kunz, Douglassville, PA (US)

( * ) Notice: Subject to any disclaimer, the term of this patent is extended or adjusted under 35 U.S.C. 154(b) by 139 days.

(21) Appl. No.: 12/979,321

(22) Filed: Dec. 27, 2010

(51) Int. Cl.
*E05D 15/22* (2006.01)

(52) U.S. Cl.
USPC ..... 49/181; 49/176; 49/445; 16/193

(58) Field of Classification Search
USPC ..... 49/176, 181, 445–447; 16/193, 197
See application file for complete search history.

(56) References Cited

U.S. PATENT DOCUMENTS 4,885,871 A * 12/1989 Westfall et al. ..... 49/176
5,210,976 A * 5/1993 Cripps ..... 49/181
5,353,548 A * 10/1994 Westfall ..... 49/446
5,463,793 A * 11/1995 Westfall ..... 16/197
5,661,927 A * 9/1997 Polowinczak et al. ..... 49/447
6,378,169 B1 * 4/2002 Batten et al. ..... 16/197
6,802,156 B2 * 10/2004 Sherrett et al. ..... 49/445
8,074,402 B2 * 12/2011 Tuller ..... 49/445
2004/0206003 A1 * 10/2004 Kunz et al. ..... 49/181
2006/0021283 A1 * 2/2006 Schultz ..... 49/445
2006/0096178 A1 * 5/2006 Braid et al. ..... 49/447
2007/0056216 A1 * 3/2007 Liang et al. ..... 49/181
2010/0313488 A1 * 12/2010 Liang et al. ..... 49/506

* cited by examiner

*Primary Examiner* — Katherine Mitchell
*Assistant Examiner* — Abe Massad
(74) *Attorney, Agent, or Firm* — LaMorte & Associates, P.C.

(57) ABSTRACT

A counterbalance system for a window assembly having a window sash that moves in a guide track. The counterbalance system has a first stop mounted in the guide track. A spring housing is placed in the guide track above the first stop. The spring housing holds the counterbalance spring that provides the counterbalance force. The spring housing is free to move along the guide track above the first stop. The spring housing is incapable of passing the first stop and traveling below the first stop. A brake shoe is positioned in the guide track. The counterbalance spring has a free end that extends from the spring housing to the brake shoe. The brake shoe is capable of moving in the guide track past the first stop. In this manner, the brake shoe can be raised above the first stop.

13 Claims, 8 Drawing Sheets

WINDOW HAVING A COUNTERBALANCE SYSTEM THAT MAXIMIZES EGRESS OPENING

BACKGROUND OF THE INVENTION

1. Field of the Invention

In general, the present invention relates to counterbalance systems for windows that prevent open window sashes from moving under the force of their own weight. More particularly, the present invention system relates to the brake shoe component of the counterbalance systems for tilt-in windows and the devices that activate the brake shoe component.

2. Description of the Prior Art

There are many types and styles of windows. One of the most common types of windows is the double-hung window. Double-hung windows are the window of choice for most home construction. A double-hung window consists of an upper window sash and a lower window sash. Either the upper window sash or the lower window sash can be selectively opened and closed by a person sliding the sash up and down within the window frame.

A popular variation of the double-hung window is the tilt-in, double-hung window. Tilt-in, double-hung windows have sashes that can be selectively moved up and down. Additionally, the sashes can be selectively tilted into the home so that the exterior of the sashes can be cleaned from within the home.

The sash of a double-hung window has a weight that depends upon the materials used to make the window sash and the size of the window sash. Since the sashes of a double-hung window are free to move up and down within the frame of a window, some counterbalancing system must be used to prevent the window sashes from always moving to the bottom of the window frame under the force of their own weight.

For many years, counterbalance weights were hung next to the window frame in weight wells. The weights were attached to the window sash using a string or chain that passed over a pulley at the top of the window frame. The weights counterbalanced the weight of the window sashes. As such, when the sashes were moved within the window frame, they had a neutral weight and friction would hold them in place.

The use of weight wells, however, prevents insulation from being packed tightly around a window frame. Furthermore, the use of counterbalance weights on chains or strings cannot be adapted well to tilt-in, double-hung windows. Accordingly, as tilt-in windows were being developed, alternative counterbalance systems were developed that were contained within the confines of the window frame and did not interfere with the tilt action of the tilt-in windows.

Modern tilt-in, double-hung windows are primarily manufactured in one of two ways. There are vinyl frame windows and wooden frame windows. In the window manufacturing industry, different types of counterbalance systems are traditionally used for vinyl frame windows and for wooden frame windows. The present invention is mainly concerned with the structure of vinyl frame windows. As such, the prior art concerning vinyl frame windows is herein addressed.

Vinyl frame, tilt-in, double-hung windows are typically manufactured with guide tracks along the inside of the window frame. Brake shoe assemblies, commonly known as "shoes" in the window industry, are placed in the guide tracks and ride up and down within the guide tracks. Each sash of the window has two tilt pins or tilt posts that extend into the shoes and cause the shoes to ride up and down in the guide tracks as the window sashes are opened or closed.

In prior art counterbalance systems, the shoes serve more than one purpose. The shoes contain a brake mechanism that is activated by the tilt post of the window sash when the window sash is tilted inwardly away from the window frame. The shoe, therefore, locks the tilt post in place and prevents the base of the sash from moving up or down in the window frame once the sash is tilted open. Second, the shoes engage coil springs. Coil springs are constant force coil springs that supply the counterbalance force to the weight of the window sash.

Single coil springs are used on windows with light sashes. Multiple coil springs are used on windows with heavy sashes. The coil springs provide the counterbalance force to the window sashes needed to maintain the sashes in place. The counterbalance force of the coil springs is transferred to the window sash through the structure of the shoes and the tilt posts that extend from the window sash into the shoes.

Prior art shoes that contain braking mechanisms and engage counterbalance coil springs are exemplified by U.S. Pat. No. 6,378,169 to Batten, entitled Mounting Arrangement For Constant Force Spring Balance.

There are many state and municipal building code statutes that affect the design of windows. For instance, building codes require that all bedrooms in a home be accessible by at least one window. Furthermore, bedroom windows must be of a size large enough for a person to pass through the window in case of a fire. The size regulated by the statute is not the size of the windowpane, but rather the size of the opening presented by a window when the sash is fully open. In modern tilt-in windows, the springs of the counterbalance system are stored in the window tracks. The presence of the counterbalance system prevents a window sash from opening fully. Due to the interfering components, the maximum opening provided by a window is always a few inches smaller than the height of the window sash. Consequently, in order to meet the building code requirements for an acceptable access opening, the windows must have sashes a few inches larger than that required opening. In other words, the window must be oversized. However, the larger a window is, the larger the counterbalance system that is required and the greater the chance that a child can tumble out of a window.

Since bedroom windows may need to be used as an escape during a fire, the windows cannot contain bars or other features that would prevent a person from inadvertently passing through the window. Although such building code statutes are intended to make homes safer, such statutes create other safety problems.

Each year, many small children are injured or killed by falling out of open windows. The accidents increase as windows are designed to become easier and easier to open. Since building codes prevent windows from being manufactured with obstructions, many parents attach aftermarket bars to windows. The aftermarket bars prevent a child from falling from the window. However, the bars also prevent a child from a window in the event of a fire. Furthermore, many aftermarket safety bars prevent a tilt-in window from tilting inwardly for cleaning.

A great need therefore exists for a new window design that can present a larger access opening without requiring a larger sash size. A need also exists for a counterbalance system that enables unobstructed access to a window during a fire, yet deters a child from accidentally opening a window and falling out. These needs are met by the present invention as described and claimed below.

SUMMARY OF THE INVENTION

The present invention is a counterbalance system for a window sash and the window assembly containing such a counterbalance system. The window assembly has a window sash that moves up and down in a guide track. The counterbalance system has a first stop that is mounted high in the guide track. A spring housing is placed in the guide track above the first stop. The spring housing holds the counterbalance spring that provides the counterbalance force to the system. The spring housing is free to move along the guide track above the first stop. The spring housing is incapable of passing the first stop in said guide track and traveling below the first stop.

A brake shoe is positioned in the guide track. The counterbalance spring has a free end that extends from the spring housing and engages the brake shoe. The brake shoe is capable of moving in the guide track past the first stop. In this manner, the brake shoe can be raised above the first stop. This enables the window sash to be opened to a greater extent than has previously been possible.

A secondary stop can also be placed in the guide track. When the brake shoe passes over a second stop, the brake shoe expands. This causes the brake shoe to engage the guide track and provided localized resistance to the movements of the window sash.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Figure 1:
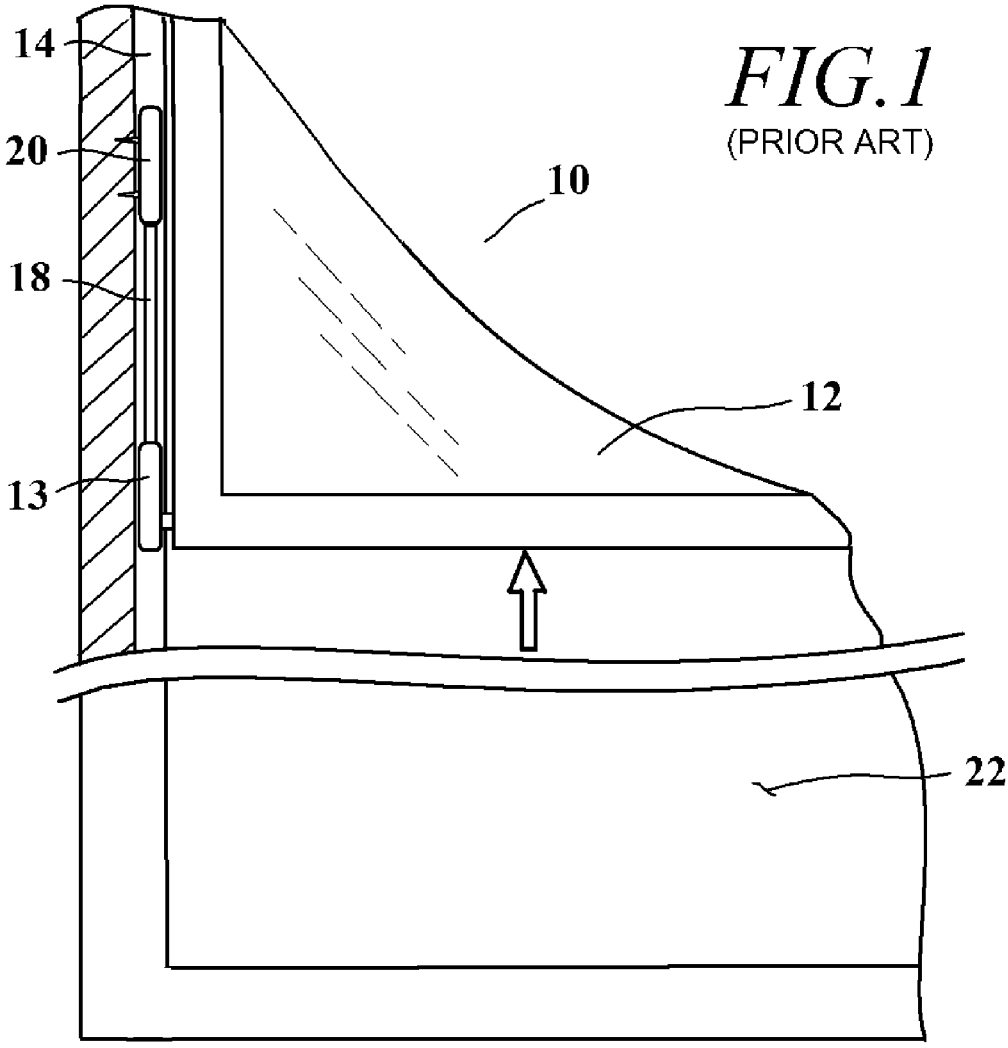
FIG. 1 (PRIOR ART)
FIG. 1 is a partially fragmented view of a tilt-in window assembly containing a prior art counterbalance system.
Figure 2:
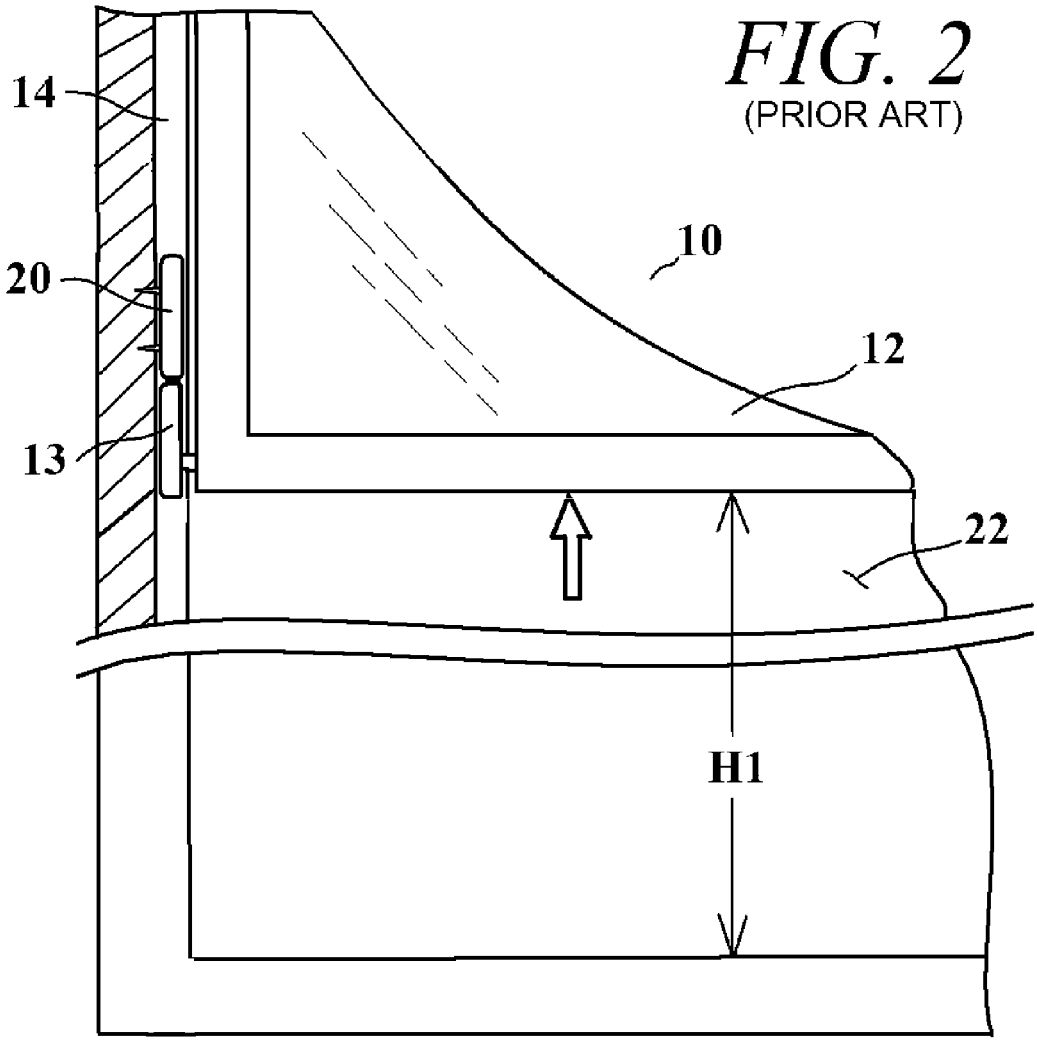
FIG. 2 (PRIOR ART)
FIG. 2 is a partially fragmented view of the assembly of FIG. 1, shown in a fully open position.

Referring to FIG. 1 and FIG. 2, a partial schematic is shown of a prior art counterbalance system for a tilt-in window. As can be seen the sash 12 of the tilt-in window 10 is engaged with a prior art brake shoe 13. The brake shoe 13 moves up and down within the guide track 14 of the window frame 16. When the sash 12 is tilted, the brake shoe 13 locks into a fixed position within the guide track 14, thereby preventing the sash 12 from moving in the guide track 14 once it is tilted.

One or more counterbalance springs 18 are kept in a stationary spring housing 20. The spring housing 20 is mounted at a fixed position within the guide track 14. The fixed position is below the tilt latch of the top rail of the sash. The tilt latch is not illustrated for clarity. The counterbalance springs 18 extend from the spring housing 20 and engage the brake shoe 13. This provides the counterbalance force needed to prevent the window sash 12 from closing as a result of its own weight.

Since the stationary spring housing 20 is mounted in the guide track 14 below the tilt latch, it will be understood that the sash 12 of the tilt-in window 10 is free to open until the brake shoe 13 contacts the stationary spring housing 20. At this point, the sash 12 is open to its maximum extent, therein producing an access opening 22 of height H1. The height H1 of the access opening 22 is typically two to four inches shorter than the height of the actual sash 12.

Figure 3:
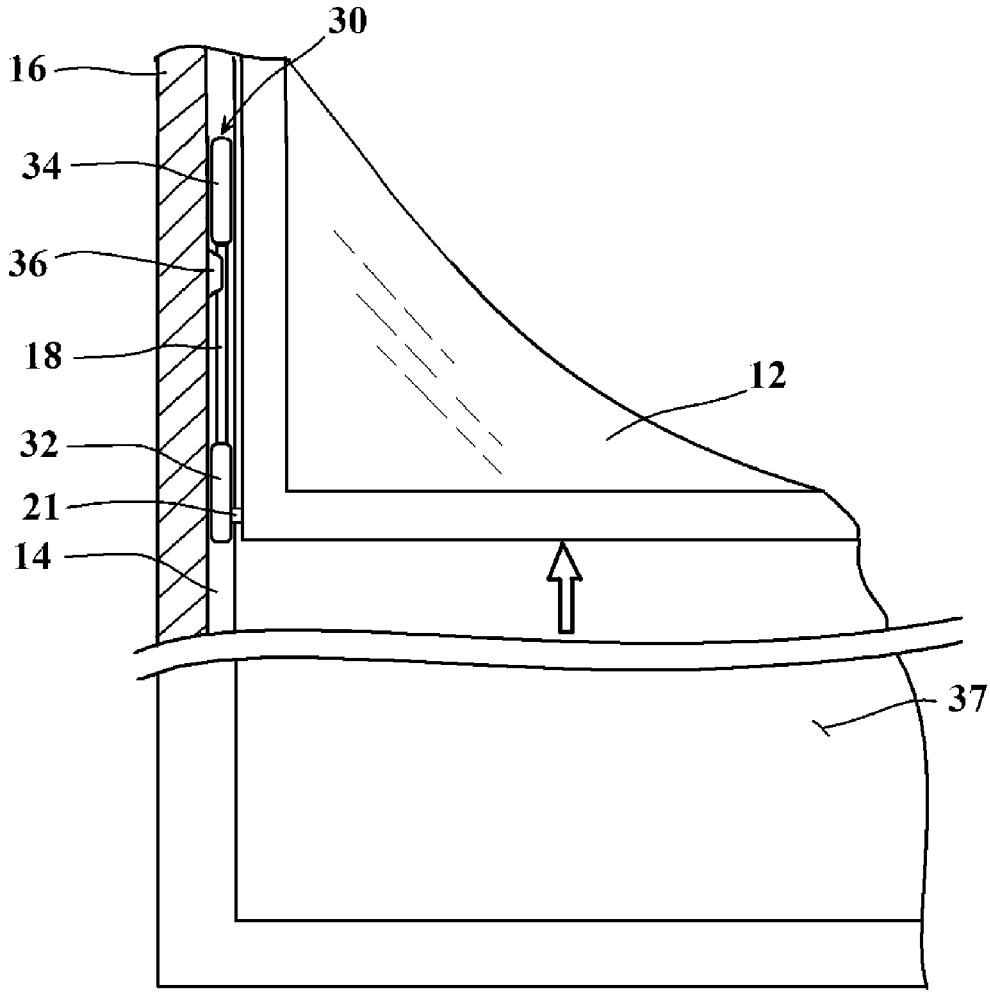
FIG. 3 is a partially fragmented view of a tilt-in window assembly in accordance with the present invention.
Figure 4:
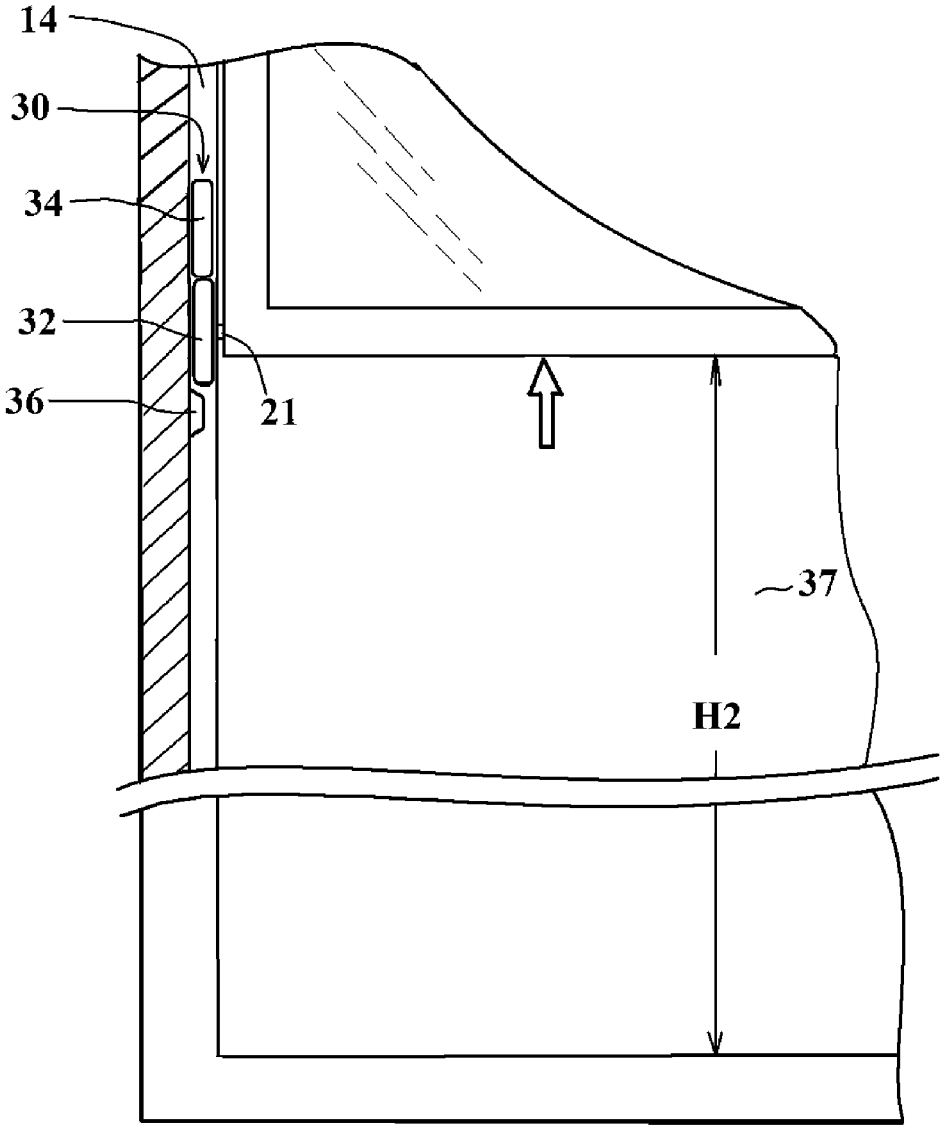
FIG. 4 is a partially fragmented view of the assembly of FIG. 3, shown in a fully open position.

Referring now to FIG. 3 and FIG. 4, a corresponding schematic of the present invention counterbalance system 30 is shown. The present invention counterbalance system 30 has a unique brake shoe 32 that connects to counterbalance springs 18. The counterbalance springs 18 are held in a free-moving spring housing 34 that is not anchored to the guide track 14. Rather, the spring housing 34 is free to move in the guide track 14 above a wedge stop 36. The wedge stop 36 is anchored to the guide track 14 in a fixed position. The free-moving spring housing 34 cannot descend in the guide track 14 below the wedge stop 36. However, as will be explained in greater detail, the brake shoe 32 is free to move past the wedge stop 36. Consequently, when the sash 12 is moved to its maximum open position, the spring housing 34 moves up in the guide track 14 and the brake shoe 32 passes the wedge stop 36. This creates an access opening 37 with a height H2 that is greater than that achievable with prior art systems that use the same sized sash.

The sash 12 has a tilt post 21 that extends out away from the side of the sash 12 and into the guide tracks 14 in the vertical sides of the window frame 16. The brake shoe 32 attaches to the tilt post 21. The brake shoe 32 serves three purposes. First, the brake shoe 32 serves as a brake mechanism that locks the bottom of a sash 12 in place within the guide track 14 when a sash 12 is tilted inwardly. Second, the brake shoe 32 serves as a point of attachment for the counterbalance springs 18. Lastly, the break shoe 32 provides resistance to movement of the sash 12 at predetermined safe-open positions.

The counterbalance springs 18 are coil springs that rotate and unwind from the spring housing 34 when the sash is closed. The spring force provided by the counterbalance springs 18 bias the free-moving spring housing 34 down against the wedge stop 36. The free end of each counterbalance spring 18 is affixed to the brake shoe 32. Accordingly, the counterbalance spring 18 applies an upward counterbalance force to the sash 12 that counteracts the weight of the sash 12.

Figure 5:
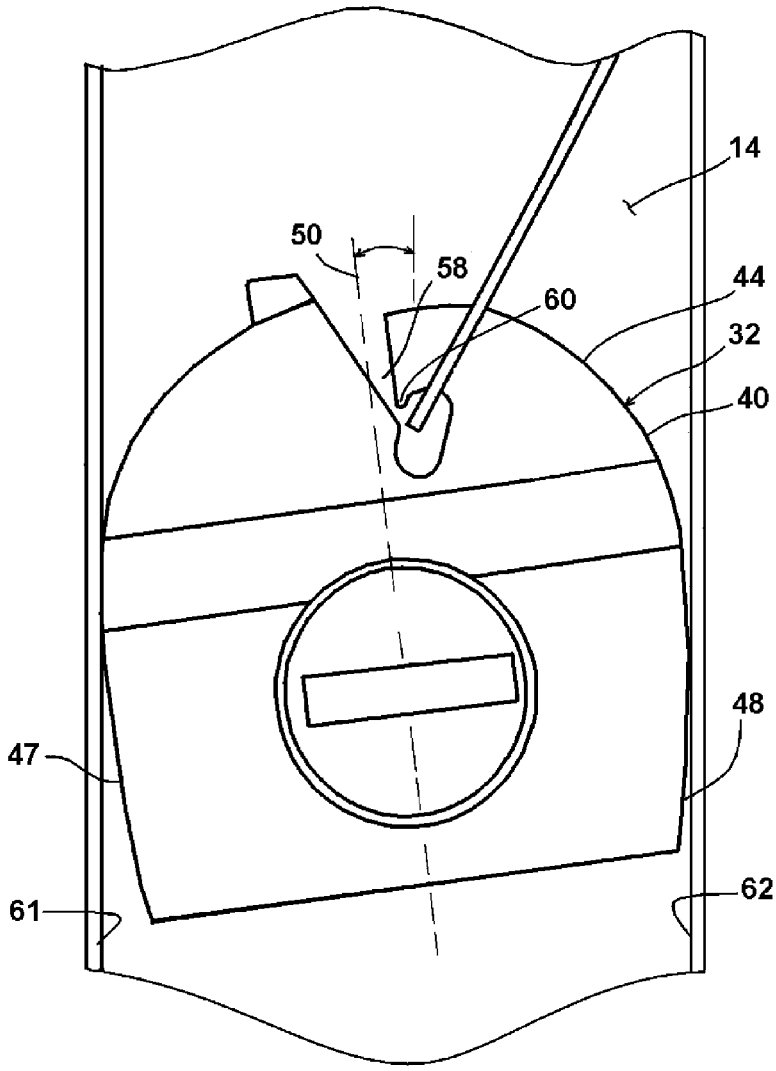
FIG. 5 is a side view of an exemplary embodiment of a brake shoe assembly in a guide track.
Figure 6:
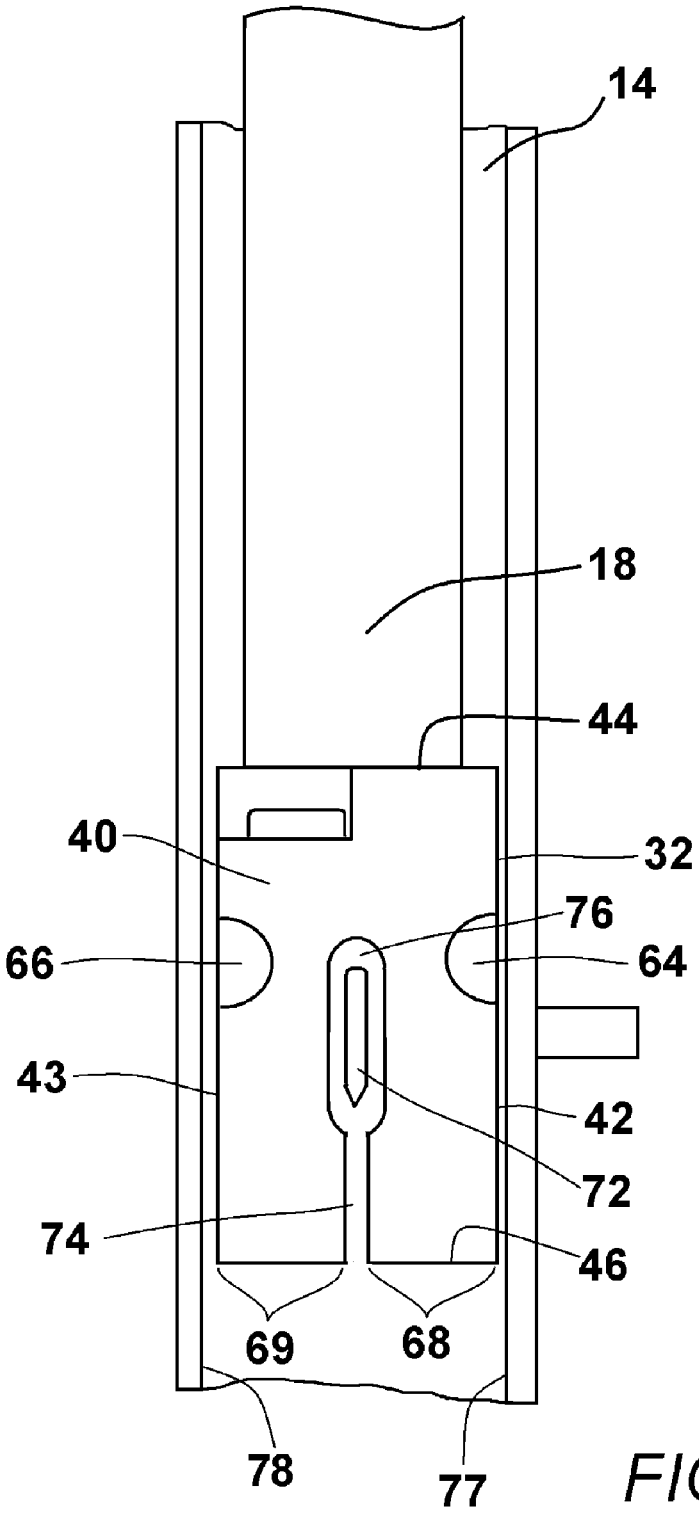
FIG. 6 is a cross-sectional view of the brake shoe assembly shown in a free position.

Referring to FIG. 5 in conjunction with FIG. 6, it can be seen that the brake shoe 32 has a uniquely shaped housing 40. The housing 40 has a face surface 42 and an opposite rear surface (not shown) that are disposed between a top edge 44, a bottom edge 46 and two side edges 47, 48. As the brake shoe 32 moves up and down within the window frame guide track 14, the side edges 47, 48 of the housing 40 ride within the confines of the guide track 14.

The side edges 47, 48 of the brake shoe housing 40 have a convex curvature. The curved side edges 47, 48 of the brake shoe housing 40 progress into a common curved top edge 44. The brake shoe housing 40 is shown with an imaginary centerline 50 extending down the center of the brake shoe housing 40 between the curved side edges 47, 48. Thus, the curved side edges 47, 48 are symmetrically disposed on either side of the imaginary centerline 50. For the purposes of this specification, the brake shoe housing 40 is considered to be in a "straight" orientation when the imaginary centerline 50 is vertical. A brake mechanism is contained within the brake shoe housing 40. The brake mechanism includes a cam actuator. The cam actuator 54 rotates within the brake shoe housing 40, as will later be explained. A portion of the cam actuator 54 extends through an access hole in the face surface 42 of the brake shoe housing 40. Consequently, when the window sash is tilted, the cam actuator 54 is caused to turn within the brake shoe housing 40.

At least one attachment slot 58 is formed in the brake shoe housing 40 through the curved top edge 44. The attachment slot 58 receives the free end of a counterbalance spring 18. A locking hook 60 is also provided. The locking hook 60 locks the free end of the counterbalance spring 18 into place.

When the brake shoe 32 is placed within a guide track 14 of a window frame, the counterbalance spring 18 applies a turning torque to the brake shoe 32. The torque causes the brake shoe 32 to cock slightly within the confines of the guide track 14. As a consequence, the imaginary centerline 50 of the brake shoe housing 40 is turned away from its initial vertical orientation. The angle of the tilt is only a few degrees, but may be as large as ten degrees. The angle at which the brake shoe 32 is tilted changes slightly as the sash of a window is raised and lowered. As the sash of a window is raised and lowered, the orientation of the counterbalance spring 18 relative the brake shoe 32 changes slightly. This results in different torque forces being applied to the brake shoe 32. Thus, variations in the tilt of the brake shoe 32 occur as a window sash is raised and lowered.

As the brake shoe 32 tilts within the guide track 14, the curved side edges 47, 48 contact the side interior walls 61, 62 of the guide track 14. However, since the side edges 47, 48 have a convex curvature, the side interior walls 61, 62 of the guide track 14 contact the brake shoe 32 at a tangent. As the tilt orientation of the brake shoe 32 changes, the tangential contact between the side interior walls 61, 62 of the guide track 14 and the brake shoe 32 remains consistent.

The tangential contact between the curved side edges 47, 48 of the brake shoe housing 40 and the side interior walls 61, 62 of the guide track 14 provide very little friction resistance to the movement of the brake shoe 32 within the guide track 14. Furthermore, since the side edges 47, 48 of the brake shoe housing 40 blend into the curved top edge 44, there is no salient point on the brake shoe housing 40 that can wear into the side interior walls 61, 62 of the guide track 14 and bind the brake shoe 32. The result is a brake shoe 32 that is more reliable and is less likely to bind than traditional prior art devices.

The brake shoe assembly 32 is shown symmetrically formed around an imaginary centerline 50. This symmetrical orientation enables the brake shoe 32 to be reversed without effect. Thus, a single brake shoe 32 can be used in both the left side guide track and the right side guide track of a tilt-in window. Although this symmetrical configuration is preferred, it will be understood that asymmetrical brake shoe housings can be manufactured that can only be used on the right side or left side of a window frame. Such asymmetrical brake shoe assemblies need only have housings that are curved at the points of contact with the window guide tracks.

Figure 7:
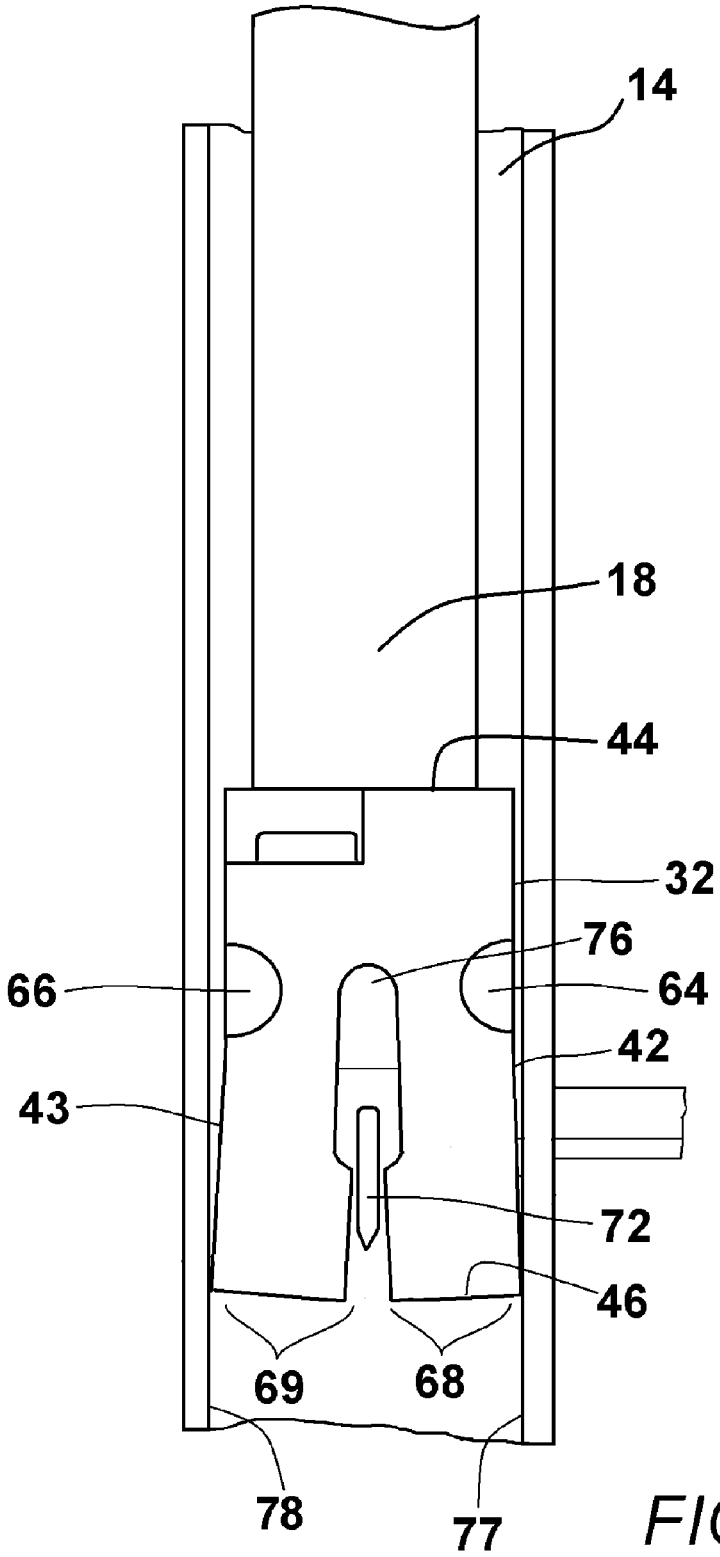
FIG. 7 is a cross-sectional view of the brake shoe assembly shown in a locked position.

In FIG. 6 and FIG. 7, it can be seen that the brake shoe housing 40 has a face surface 42 and a rear surface 43. A first lateral groove 66 is formed across the face surface 42 of the brake shoe housing 40. A parallel second lateral groove 64 is formed in the rear surface 43 of the brake shoe housing 40 at a corresponding position. Above the level of the first and second lateral grooves 64, 66, the brake shoe housing 40 is mostly solid. However, below the level of the first and second lateral grooves 64, 66, the brake shoe housing 40 is divided into a separate face section 68 and rear section 69.

The first and second lateral grooves 64, 66 cause the material of the brake shoe housing 40 to be thin. The first and second lateral grooves 64, 66, therefore, create living hinges that allow the face section 68 and the rear section 69 of the brake shoe housing 40 to be selectively spread apart by the application of a spreading force.

In FIG. 6 and FIG. 7, it can be seen that the cam actuator 54 that extends through the brake shoe housing 40 contains a cylindrical body 70. On the exterior of the cylindrical body 70 is a cam arm 72. The cam arm 72 extends across no more than half the circumference of the cylindrical body 70.

Inside the brake shoe housing 40, the face section 68 of the housing 40 and the rear section 69 of the housing 40 are separated by a severance space 74. The severance space 74 is narrow below the level of the first and second lateral grooves 64, 66. However, just above the first and second lateral grooves 64, 66 there is an enlarged area 76.

When the sash of a window is in its functional, non-tilted position, the tilt-post 21 of the window orients the cam actuator 54 so that the cam arm 72 is positioned within the enlarged area 76 of the severance space 74. When in such an orientation, the cam arm 72 does not act to spread the face section 68 of the housing 40 from the rear section 69 of the housing 40. Rather, the enlarged area 76 is slightly wider than the cam arm 72, thus the cam arm 72 has no effect on the brake shoe housing 40.

The distance between the face surface 42 of the brake shoe 32 and the rear surface 43 of the brake shoe 32 is smaller than the distance between a forward wall 77 and a rearward wall 78 of the window frame guide track 14. The brake shoe 32 is therefore free to move within the window frame guide track 14 uninhibited.

Referring now to FIG. 7, it can be seen that the tilt-post 21 from the window has rotated. This rotation occurs when the sash of the window is tilted inwardly. As the tilt-post 21 rotates, the cam actuator 54 rotates. This causes the cam arm 72 to rotate out of the enlarged area 76 of the severance space 74. As the cam arm 72 rotates out of the enlarged area 76, the cam arm 72 passes between the face section 68 and the rear section 69 of the brake shoe housing 40. This forces the face section 68 and the rear section 69 of the brake shoe housing 40 to spread apart.

The face section 68 and the rear section 69 hinge about the first and second lateral grooves 64, 66 as they spread. As such, the distance between the face surface 42 and the rear surface 43 of the brake shoe housing 40 increases and is at its maximum proximate the bottom edge 46. As the face surface 42 and the rear surface 43 spread, both surfaces contact, and are biased against, the forward wall 77 and rearward wall 78 of the window frame guide track 14. This causes the brake shoe 32 to bind within the window frame guide track 14 and lock into place. It will therefore be understood that once a window sash is tilted and the cam actuator 54 is caused to turn, the brake shoe 32 spreads and the brake shoe 32 locks in place within the window frame guide track 14.

Once the window sash is rotated back to its functional position, the cam arm 72 on the cam actuator 54 rotates back to the enlarged area 76 of the severance space 74. The bias force separating the face section 68 and the rear section 69 of the brake shoe housing 40 is removed. The face surface 68 and the rear surface 69 then converge back toward each other until the brake shoe 32 is again free to move up and down within the confines of the window frame guide track 14.

Figure 8:
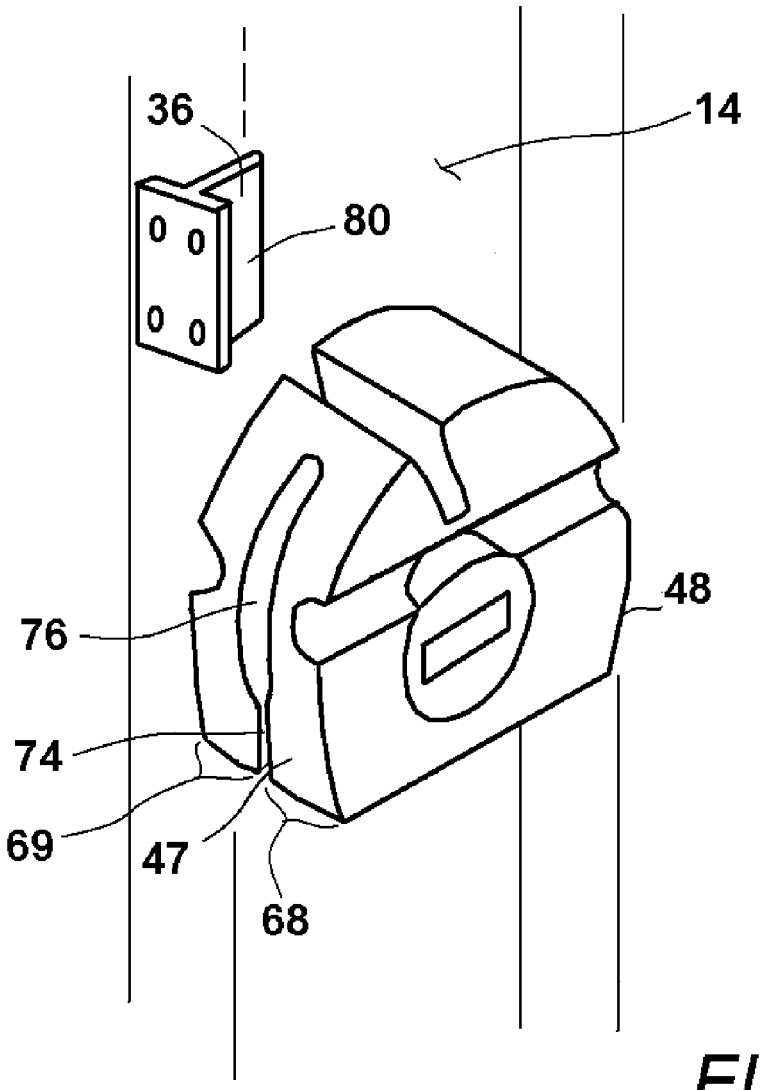
FIG. 8 is a perspective view of the brake shoe assembly engaging a locking wedge.

Referring to FIG. 7 and FIG. 8 in conjunction with FIG. 3 and FIG. 4, it can be seen that the enlarged area 76 of the severance space 74 extends through both the side edges 47, 48 and the top edge 44 of the brake shoe housing 40. The wedge stop 36 is anchored in the window frame guide track 14. The wedge stop 36 has an elongated wedge element 80 that passes into the enlarged area 76 of the severance space 74 as the brake shoe 32 moves toward the wedge stop 36 in the window frame guide track 14. If the brake shoe 32 further advances while in contact with the wedge stop 36, the wedge element 80 passes into the enlarged area 76 of the severance space 74 and acts to spread the face section 68 and the rear section 69 of the brake shoe housing 40. This causes the brake shoe housing 40 to engage the window frame guide track 14 and temporarily lock in place.

When the brake shoe 32 is engaged with the wedge stop 36 and the lower sash 12 is at rest, a significant force must be applied to the lower sash 12 in either the upward direction or the downward direction to free the brake shoe 32 from the wedge stop 36. This force can be controlled by varying the length and thickness of the wedge stop 36 and/or the severance space 74. Preferably, the force needed to move the lower sash 12 should exceed ten pounds.

The wedge stop 36 has a length that is preferably between one-half inch and two inches. It will be understood that when the window is fully open from a closed position, the brake shoe 32 moves with the lower sash 12 and passes across the wedge stop 36 in a fraction of a second. Since the brake shoe 32 is moving quickly, the kinetic energy and momentum of the lower sash 12 carries the brake shoe 32 past the wedge stop 36 before the wedge stop 36 can bind the brake shoe 32. A person who is fully opening the lower sash 12 will only experience a small, momentary resistance as the break shoe 32 passes over the wedge stop 36. It will therefore be understood that the window sash 12 can be opened and closed in a normal fashion.

As has been mentioned, the wedge stop 36 acts as a stop to the free-moving spring housing 34. The ability of the brake shoe 32 to rise up past the wedge stop 36 enables the sash 12 to open an inch or two higher than would have otherwise been possible.

Referring now to FIG. 8 in conjunction with FIG. 7, it will be understood that more than one wedge stop can be placed in the window guide track 14. A second wedge stop 36(A) can be placed in the guide track 14 only a few inches up from the bottom. In this manner, the sash 12 would lock into a safe-open position while providing only a small access opening. When the brake shoe 32 is stopped in such a safe-open position, there is no kinetic energy or momentum moving the lower sash 12. The second wedge stop 36(A) therefore binds the brake shoe assembly 32 and retains the lower sash 12 in the safe open position. A small child, therefore, would lack the strength to open the window sash further. The window sash 12 could therefore be open for ventilation while still remaining safe to small children. Additionally, the resistance force that holds the lower sash 12 into its child-safe open position only becomes evident if the lower sash 12 is specifically stopped at the safe open position so that all momentum is lost. If an adult opens the lower sash 12 from its fully closed position directly to its fully open position, then little resistance is experienced by the lower sash 12 as it passes the safe open position. The lower window sash 12 can therefore be opened from a fully closed position in a traditional manner using a traditional amount of force.

The result is a window sash 12 that opens normally from its closed position to its fully open position. However, if the lower sash 12 is purposely opened to a safe open position, the lower sash 12 cannot be opened any farther by a child. The lower sash 12, therefore, helps prevent falling accidents while not detracting from the ability of the window to fully open during a fire.

It will be understood that the embodiments of the present invention counterbalance system that are described and illustrated herein are merely exemplary and a person skilled in the art can make many variations to the embodiment shown without departing from the scope of the present invention. It will also be understood that although the brake shoe and wedge stop were applied to a lower sash of a double hung window, such elements can also be applied to upper sashes and single hung windows. All such variations, modifications and alternate embodiments are intended to be included within the scope of the present invention as defined by the appended claims.

What is claimed is:

1. A counterbalance system for counterbalancing a window sash in a guide track of a window frame, said counterbalance system comprising:

a first stop mounted in said guide track;

a counterbalance spring;

a spring housing for holding said counterbalance spring, wherein said spring housing is free to move along said guide track above said first stop, and wherein said spring housing is incapable of passing said first stop in said guide track;

a brake shoe positioned in said guide track, said brake shoe having two sections separated by a severance space, said counterbalance spring having a free end that extends from said spring housing and engages said brake shoe, wherein said brake shoe is capable of moving in said guide track past said first stop, and wherein a portion of said first stop passes through said severance space as said brake shoe passes said first stop.

2. The system according to claim 1, wherein said window sash is a tilt-in window sash that is capable of being manipulated into a tilted position, wherein said brake shoe locks into a set position in said guide track when said window sash is in said tilted position.

3. The system according to claim 1, wherein said brake shoe is selectively configurable into an expanded configuration where said brake shoe engages said guide track with an interference fit.

4. The system according to claim 3, wherein said brake shoe changes to said expanded configuration as said brake shoe passes said first stop in said guide track.

5. The system according to claim 3, further including a second stop mounted to said guide track a predetermined distance below said first stop, wherein said brake shoe is capable of passing said second stop as said brake shoe moves in said guide track.

6. The system according to claim 5, wherein said brake shoe changes to said expanded configuration as said brake shoe passes said second stop in said guide track.

7. The system according to claim 6, wherein said window sash is open no more than four inches when said brake shoe contacts said second stop.

8. A window assembly, comprising:

a window frame;

a guide track mounted to said window frame;

a window sash that moves within said guide track between a fully open position and a fully closed position;

a counterbalance system for counterbalancing said window sash in said window frame as said window sash moves between said fully open position and said fully closed position, wherein said counterbalance system includes;

i. a first stop mounted in said guide track;

ii. a spring housing disposed in said guide track above said first stop, wherein said spring housing is free moving in said guide track but cannot move past said first stop;

iii. a brake shoe coupled to said window sash, wherein said brake shoe has two sections separated by a severance space; and iv. a spring that extends from said spring housing to said brake shoe;

wherein a portion of said first stop passes through said severance space as said brake shoe travels in said guide track and passes said first stop.

9. The system according to claim 8, wherein said window sash is a tilt-in window sash that is capable of being manipulated into a tilted position, wherein said brake shoe locks in a set position in said guide track when said window sash is in said tilted position.

10. The system according to claim 8, wherein said brake shoe is selectively configurable into an expanded configuration where said brake shoe engages said guide track with an interference fit.

11. The system according to claim 10, wherein said brake shoe changes to said expanded configuration as said brake shoe passes said first stop in said guide track.

12. The system according to claim 10, further including a second stop mounted to said guide track a predetermined distance below said first stop, wherein said brake shoe is capable of passing said second stop as said brake shoe moves in said guide track.

13. The system according to claim 12, wherein said brake shoe changes to said expanded configuration as said brake shoe passes said second stop in said guide track.

* * * * *